US008429854B1

(12) United States Patent
Plummer et al.

(10) Patent No.: US 8,429,854 B1
(45) Date of Patent: Apr. 30, 2013

(54) HURRICANE-RESISTANT STORM DOOR ASSEMBLY

(75) Inventors: John B. Plummer, Houston, TX (US); Joseph Gene Denley, Cypress, TX (US)

(73) Assignee: Glasscraft Door Company, Houston, TX (US)

( * ) Notice: Subject to any disclaimer, the term of this patent is extended or adjusted under 35 U.S.C. 154(b) by 32 days.

(21) Appl. No.: 13/097,658

(22) Filed: Apr. 29, 2011

(51) Int. Cl.
*E06B 3/68* (2006.01)
*E06B 7/00* (2006.01)
*E06B 9/01* (2006.01)

(52) U.S. Cl.
USPC ..... 49/54; 49/70

(58) Field of Classification Search ..... 49/501, 49/163, 168, 169, 171, 50, 61, 62, 54, 70; 428/319.3, 319.7, 314.4; 52/309.9, 455, 52/456, 783.12, 784.1, 784.15, 784.16
See application file for complete search history.

(56) References Cited

U.S. PATENT DOCUMENTS

| | | | | | |
|---|---|---|---|---|---|
| 241,891 | A | * | 5/1881 | Specht | 312/101 |
| 436,522 | A | * | 9/1890 | Geddes | 49/50 |
| 1,521,393 | A | * | 12/1924 | Ross | 109/21.5 |
| 1,799,164 | A | * | 4/1931 | Griswold | 49/171 |
| 2,132,507 | A | * | 10/1938 | Baker | 110/173 R |
| 2,431,416 | A | * | 11/1947 | Nagel | 160/127 |
| 2,676,652 | A | * | 4/1954 | Duncan | 160/104 |
| 2,687,771 | A | * | 8/1954 | Wilson | 160/225 |
| 2,849,764 | A | * | 9/1958 | Rich et al. | 49/70 |
| 3,334,464 | A | * | 8/1967 | Charles | 52/784.15 |
| 3,533,190 | A | * | 10/1970 | Johnson et al. | 49/501 |
| 3,785,913 | A | * | 1/1974 | Hallamore | 428/71 |
| 3,885,348 | A | * | 5/1975 | Swearingen | 49/171 |
| 4,019,281 | A | * | 4/1977 | Weiler | 49/56 |
| 4,121,378 | A | * | 10/1978 | Wahl | 49/55 |
| 4,148,157 | A | * | 4/1979 | Franc | 49/501 |
| 4,263,747 | A | * | 4/1981 | Coltrin et al. | 49/56 |
| 4,384,436 | A | * | 5/1983 | Green | 52/202 |
| 4,624,072 | A | * | 11/1986 | Zilkha | 49/55 |
| 4,631,862 | A | * | 12/1986 | Gallardo | 49/56 |
| 4,752,517 | A | * | 6/1988 | Beitel | 428/122 |
| 5,061,022 | A | * | 10/1991 | Meriwether | 312/324 |
| 5,207,044 | A | * | 5/1993 | LaSee | 52/476 |
| D341,430 | S | * | 11/1993 | Cardona | D25/48.8 |
| 5,417,029 | A | * | 5/1995 | Hugus et al. | 52/792.1 |
| 5,426,891 | A | * | 6/1995 | Svehaug | 49/171 |
| 5,579,605 | A | * | 12/1996 | Tanaka | 49/171 |
| 5,664,815 | A | * | 9/1997 | Kornder | 292/288 |
| 5,701,714 | A | * | 12/1997 | Dietrichs | 52/665 |
| 5,743,057 | A | * | 4/1998 | Martin | 52/457 |

(Continued)

*Primary Examiner* — Katherine Mitchell
*Assistant Examiner* — Shiref Mekhaeil
(74) *Attorney, Agent, or Firm* — Buskop Law Group, PC; Wendy Buskop

(57) ABSTRACT

A hurricane storm resistant door assembly with a door having a frame; closed cell foam disposed within the frame; a front skin of a first fiber reinforced polymer substrate; a back skin, a top coat that covers the first and second fiber reinforced polymer substrates; at least one port door fixedly formed and secured in the foam; an opening in the port door; a double welded impact resistant grill over the opening with a leg extending from and intersecting center grid; a foot secured to each leg; a fastening hole centrally formed in each foot; a plurality of securing rings encircling a center grid member and two support barrier connections; a connection hole per foot disposed through the door, penetrating the skin and foam for fastening the double weld impact resistant grill to the door enabling the hurricane storm resistant door assembly to sustain 37 mph flying projectiles.

10 Claims, 5 Drawing Sheets

U.S. PATENT DOCUMENTS 5,872,165 A * 2/1999 Oberg et al. ..... 524/100
D440,320 S * 4/2001 Ben-Ezra ..... D25/48.3
D443,366 S * 6/2001 Ben-Ezra ..... D25/48.3
6,311,454 B1 * 11/2001 Kempel ..... 52/784.15
6,564,510 B2 * 5/2003 Juntunen et al. ..... 49/103
6,619,010 B2 * 9/2003 Wang Chen ..... 52/784.13
RE39,091 E * 5/2006 Kuelker ..... 52/506.05
D529,191 S * 9/2006 Careri ..... D25/48.8
7,448,668 B2 * 11/2008 Brabeck et al. ..... 296/146.1
7,918,063 B2 * 4/2011 Etemadi ..... 52/455
2003/0082305 A1 * 5/2003 Krohn ..... 427/282
2008/0163550 A1 * 7/2008 Lomax et al. ..... 49/169
2010/0209621 A1 * 8/2010 Wakalopulos ..... 427/558
2011/0147358 A1 * 6/2011 Kober et al. ..... 219/202

* cited by examiner

HURRICANE-RESISTANT STORM DOOR ASSEMBLY

FIELD

The present embodiments relate to an exterior hurricane storm resistant door assembly.

BACKGROUND

A need exists for a hurricane storm resistant door assembly with at least one opening, which can withstand forces, such as forces caused from impact of debris moving at a high speed, such as 37 miles per hour.

A need exists for a hurricane storm resistant door assembly that can meet or exceed impact certification testing standards.

The present embodiments meet these needs.

BRIEF DESCRIPTION OF THE DRAWINGS

The detailed description will be better understood in conjunction with the accompanying drawings as follows.

Figure 1:
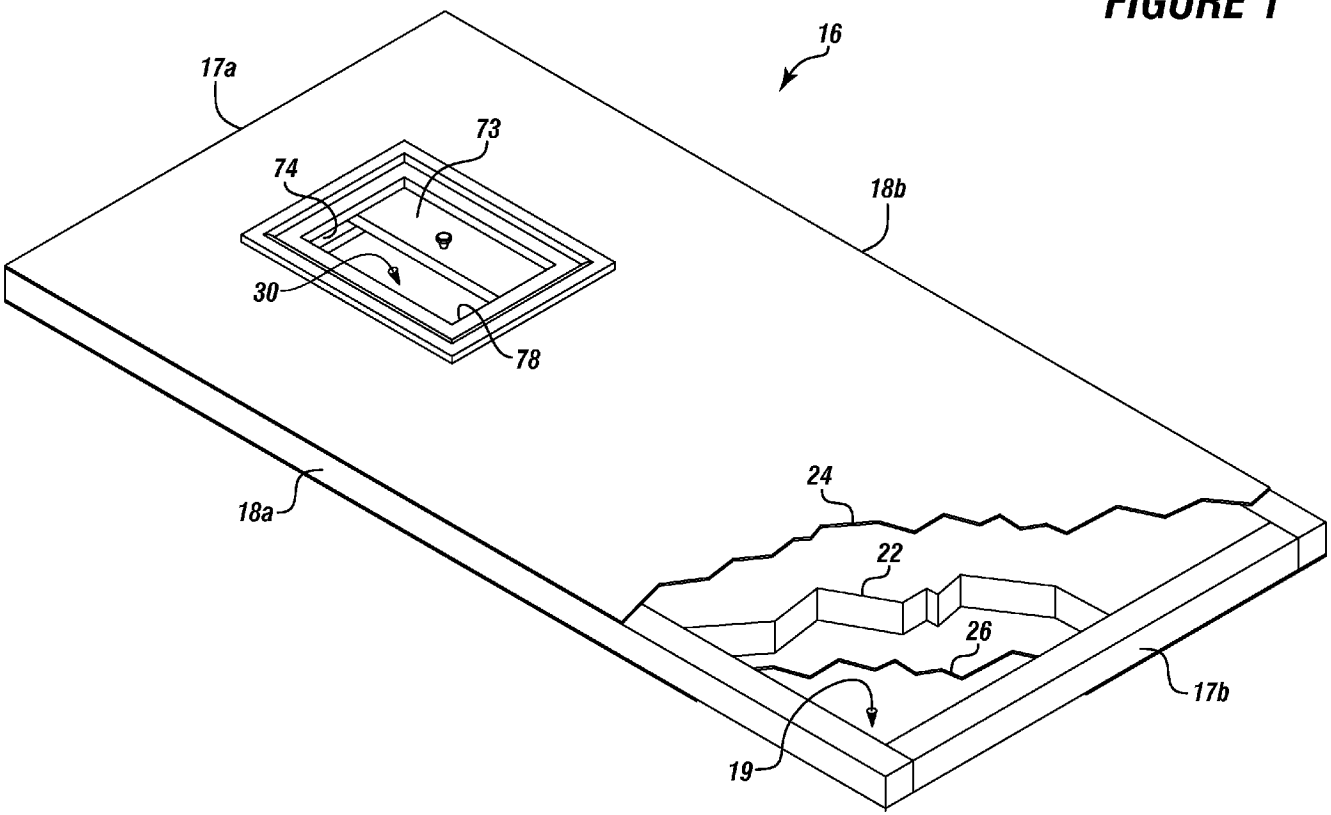
FIG. 1 depicts a partial cut away section of the door according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a hurricane storm resistant door assembly.

The hurricane resistant storm door assembly can have a door with two horizontal edges parallel to one another and two vertical edges parallel to one another. The horizontal edges are connected to the vertical edges, and a space is formed between the horizontal edges and the vertical edges.

The frame of the door can be made from wood, metal, composite, polymer, copolymer, or combinations thereof.

A closed cell foam can be disposed in the space between the connected edges. The closed cell foam can be a polystyrene, a polyurethane, or combinations thereof.

A front skin can be disposed on the connected edges and closed cell foam. The front skin can be made from a first fiber reinforced polymer substrate.

The fiber reinforced polymer substrate can be any polymer substrate used in the art that would be known to one skilled in the art with the aid of this disclosure.

A back skin can be disposed on the connected edges and closed cell foam. The back skin can be made from a second fiber reinforced polymer substrate.

One or more top coats can be disposed on the first fiber reinforced polymer substrate and the second fiber reinforced polymer substrate. The top coat can provide a seal to protect the first fiber reinforced polymer substrate and the second fiber reinforced polymer substrate. The top coats can be a clear coat, a colored coat, an ultraviolet light coating on the front skin, or combination thereof.

A port hole can be formed through the closed cell foam, the front skin, the back skin, and the substrates. A port door can be located on the front skin or back skin to transition the port hole from a closed state to an open state.

The port door can be solid. In one or more embodiments, at least one port door opening can be formed in the port door. Transparent material can be located in the port door opening. The transparent material can be glass, insulated glass, clear glass, Plexiglas, or any other rigid transparent material.

A double welded impact resistant grill can be located on the front skin. At least a portion can be parallel to the port hole and the front skin.

In one or more embodiments the double welded impact resistant grill can have a first member that intersects a second member. For example, the first member can intersect the second member at 90 degrees. The two members can be welded together.

Four or more legs can be located on the double welded impact resistant grill. Each leg can have a foot configured to secure the double welded impact resistant grill to the front skin. In one or more embodiments, the legs can be welded to the ends of the first member and second member. The feet can be integral with the legs, formed on the legs, or connected to the legs. The feet can be configured to sit flush with the front skin.

A fastening hole in the foot can receive a mechanical fastener that can secure the double welded impact resistant grill to the front skin. The fastening hole can be centrally formed in each foot.

One or more support barrier connections can be connected to the first member and the second member. Each support barrier connection can be secured to the first member and the second member by a securing ring. For example, a first securing ring can be disposed about the first member and a first barrier connection and a second securing ring can be disposed about the second member and the first barrier connection.

The securing ring can have outer dimension of from about 15 mm to about 35 mm in length; from about 15 mm to about 50 mm in width, and from about 6 mm to 20 mm in thickness. For example, the securing ring can be about 27 mm long, 43 mm wide, and 7 mm thick.

A plurality of connection holes can be formed through the front skin, the back skin, and the closed cell foam of the door. The connection holes in the door can correspond to the fastening holes of each foot.

Fasteners can be used, such as nuts and bolts, to secure the grill to the door through the fastening holes and connection holes.

The attached double weld impact resistant grill and the door enables the hurricane storm resistant door assembly to sustain an impact from flying projectiles of at least 37 mph.

Turning now to the Figures, FIG. 1 depicts a partial cut away section of the door 16 according to one or more embodiments.

The door 16 can have a first horizontal edge 17*a*, a second horizontal edge 17*b*, a first vertical edge 18*a*, and a second vertical edge 18*b*. The vertical edges 18*a* and 18*b* can be parallel to one another, and the horizontal edges 17*a* and 17*b* can be parallel to one another. The horizontal edges 17*a* and

17*b* can be connected to the vertical edges 18*a* and 18*b*. A space 19 can be formed between the connected edges 17*a*, 17*b*, 18*a*, and 18*b*.

A closed cell foam 22 can be located in the space 19. The closed cell foam 22 can have a high R value. Accordingly, the closed cell foam can provide thermal and sound insulation.

A front skin 24 can be disposed on a front side of the edges and the closed cell foam 22. The front skin 24 can be a fiber reinforced polymer substrate substantially between 2 mm and 3.5 mm.

A port opening 30 can be located in the door 16. The port opening 30 can be formed through the closed cell foam 22, the front skin 24, and a back skin 26. The back skin 26 can be disposed on the edges and the closed cell foam 22 opposite the front skin 24. The back skin 26 can be fiber reinforced polymer substrate. The back skin 26 can have a thickness of from 2 mm to 3.5 mm.

A first rail 74 can be disposed within the port hole adjacent a top portion of the port opening 30. A second rail 78 can be disposed within the port opening 30 adjacent a bottom portion of the port opening 30. A port door 73 can be disposed between the rails. The port door 73 can engage both rails 74 and 78 allow the port door 73 to slidingly transition the opening from a closed state to an open state.

Figure 2:
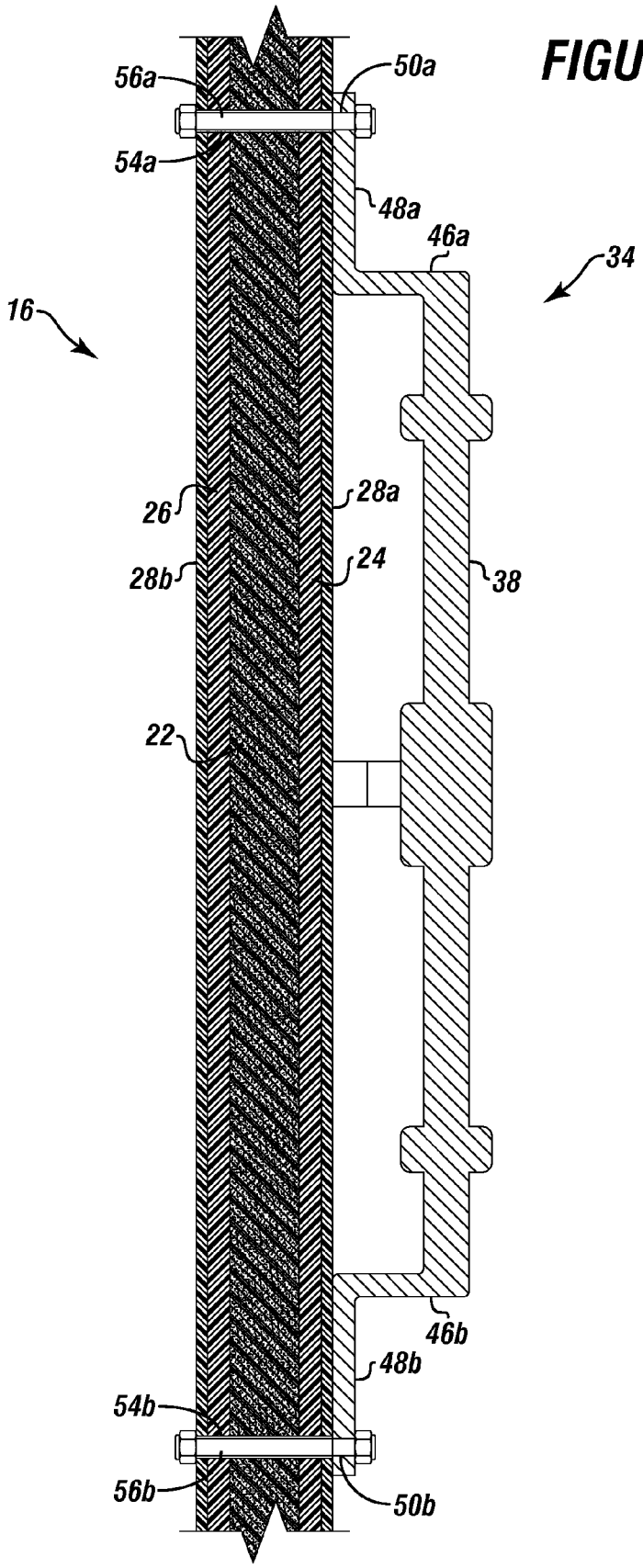
FIG. 2 depicts a schematic side view of a portion of to the door of FIG. 1 with a double welded impact resistant grill attached thereto.

FIG. 2 depicts a schematic side view of a portion of to the door 16 of FIG. 1 with a double welded impact resistant grill 34 attached thereto.

A first top coat 28*a* can be disposed on at least the front skin 24 to provide improved weather resistance. A second top coat 28*b* can be disposed on at least the back skin 26. The top coats 28*a* and 28*b* can be at least 0.060 of an inch thick.

A double welded impact resistant grill 34 can be secured to the front skin 24. The double welded impact resistant grill 34 can be parallel to the port opening.

The double welded impact resistant grill 34 can be formed from an intersecting center grid that can include a first rod 38. Legs 46*a* and 46*b* can be on each of the ends of the first rod 38.

The legs 46*a* and 46*b* can have a first foot 48*a* and a second foot 48*b*. The first foot 48*a* and the second foot 48*b* can be configured to form a flush engagement with the front skin 24.

The first foot 48*a* can have a first mounting hole 50*a* formed therethrough. A first fastener 56*a* can pass through the first mounting hole 52*a* into a first connection hole 54*a*. The first connection hole 54*a* can be formed in the door 16 for securing the double welded impact resistant grill 34 to the door 16 through the closed cell foam 22, the front skin 24, and the back skin 26.

The second foot 48*b* can have a second mounting hole 50*b* formed therethrough. A second fastener 56*b* can pass through the second mounting hole 50*b* into a second connection hole 54*b*. The second connection hole 54*b* can be formed in the door 16 for securing the double welded impact resistant grill 34 to the door 16 through the closed cell foam 22, the front skin 24, and the back skin 26.

Figure 3:
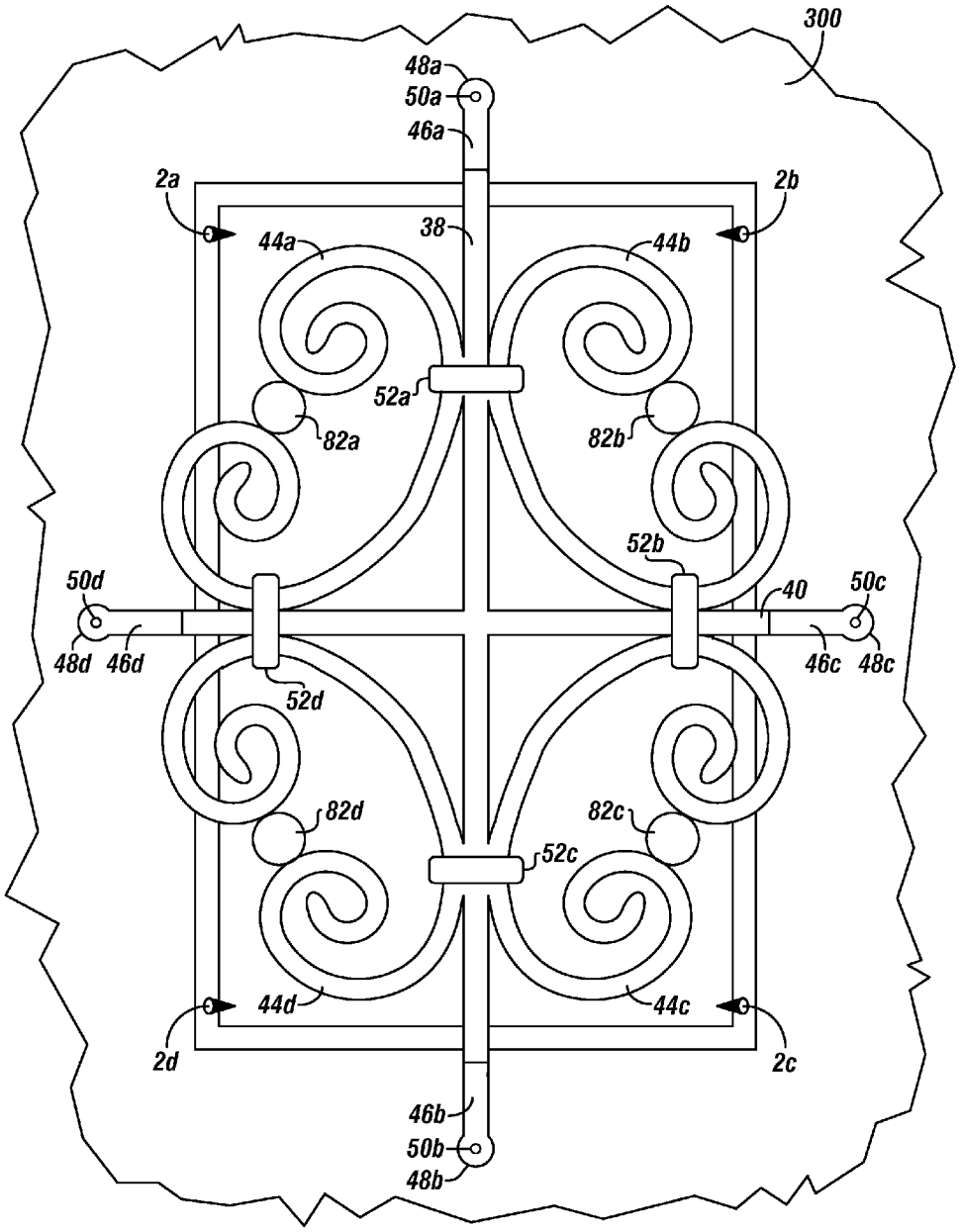
FIG. 3 depicts a front view of a double welded impact resistant grill disposed on door according to one or more embodiments.

FIG. 3 depicts a front view of a double welded impact resistant grill disposed on a door 300 according to one or more embodiments.

The first rod 38 can intersect a second rod 40 forming four zones 2*a*, 2*b*, 2*c* and 2*d*.

A plurality of support barrier connections 44*a*, 44*b*, 44*c* and 44*d* can be secured to one the rods 38 and 40.

A plurality of securing rings 52*a*, 52*b*, 52*c*, and 52*d* can be used to reinforce the connection and surround the support barrier connections 44*a*, 44*b*, 44*c* and 44*d* and the rods 38 and 40.

Connecting members 82*a*, 82*b*, 82*c*, and 82*d* can connect to the ends of support barrier connections 44*a*, 44*b*,44*c* and 44*d*.

The first rod 38 can have legs 46*a* and 46*b* on the ends thereof. The second rod 40 can have legs 46*c* and 46*d* on the ends thereof. The each leg 46*a*, 46*b*, 46*c*, and 46*d* can have feet 48*a*. 48*b*, 48*c*, and 48*d*. The feet 48*a*, 48*b*, 48*c*, and 48*d* can have connecting holes 50*a*, 50*b*, 50*c*, and 50*d*.

Figure 4:
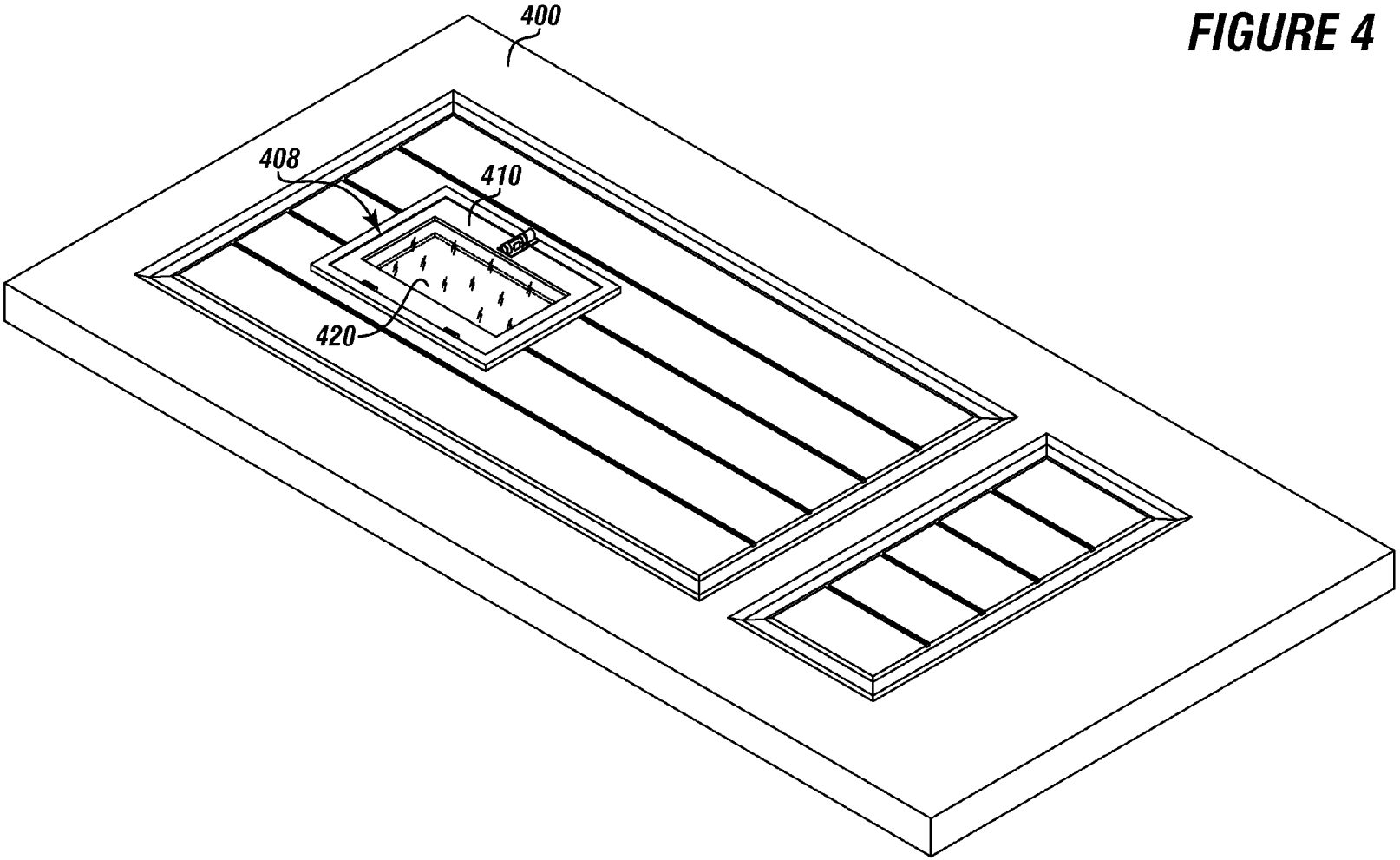
FIG. 4 depicts an embodiment of a door that the double welded impact resistant grill can be attached to according or more embodiments.

FIG. 4 depicts an embodiment of a door 400 that the double welded impact resistant grill can be attached to according or more embodiments. The door 400 can have a port hole 408 formed therethrough. A port door 410 can transition the port hole 408 from an open and closed state. The port door 410 can have a port window 420.

Figure 5:
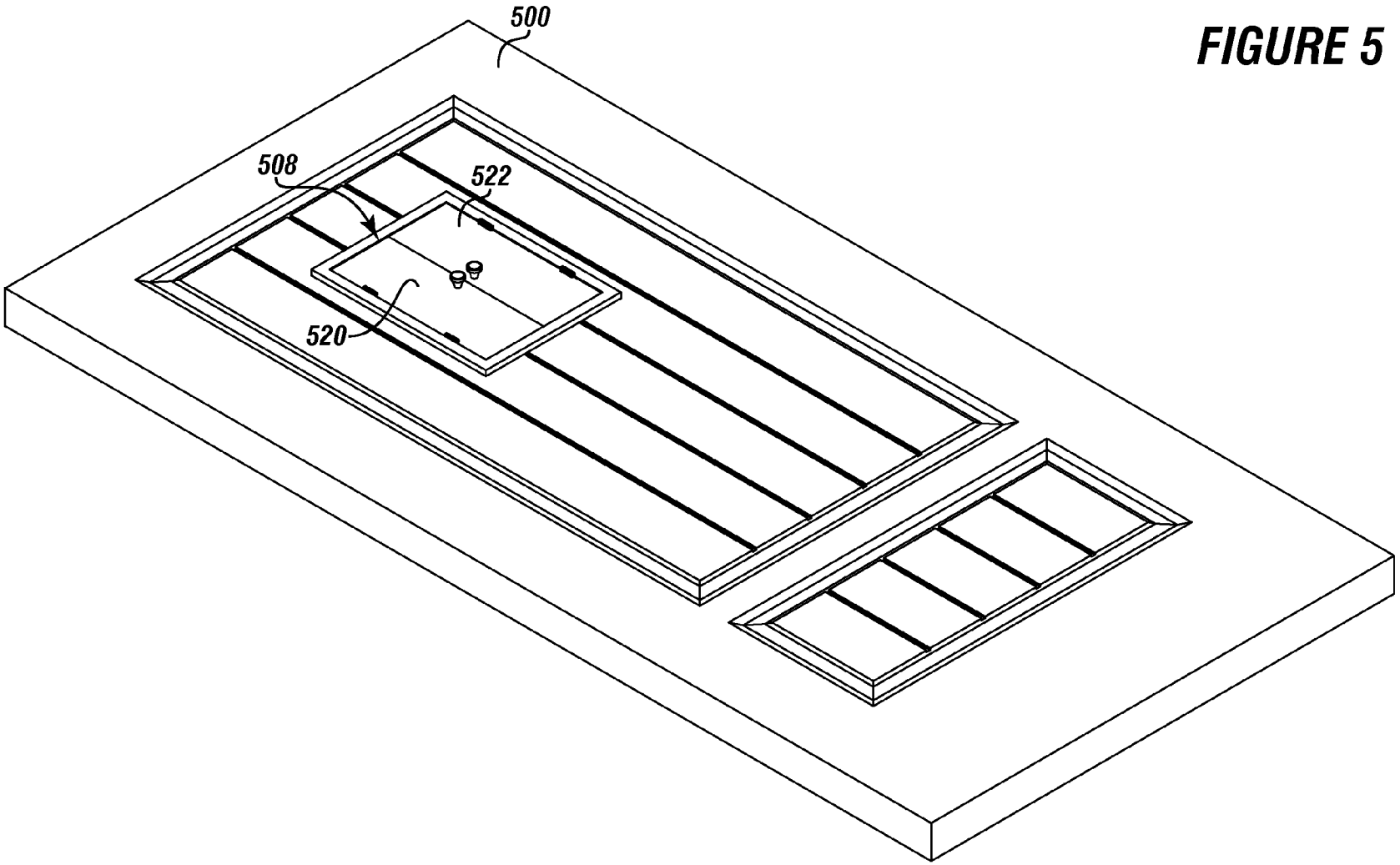
FIG. 5 depicts an embodiment of a door that the double welded impact resistant grill can be attached to according or more embodiments.

FIG. 5 depicts an embodiment of a door 500 that the double welded impact resistant grill can be attached to according or more embodiments. The door 500 can have a port hole 508 formed therethrough. A first port door 520 and a second port door 522 can transition the port hole 508 from an open and closed state.

While these embodiments have been described with emphasis on the embodiments, it should be understood that within the scope of the appended claims, the embodiments might be practiced other than as specifically described herein.

What is claimed is:

1. A hurricane-storm resistant door assembly comprising:

a. a door comprising:

(i) a first horizontal edge substantially parallel to a second horizontal edge;

(ii) a first vertical edge substantially parallel to a second vertical edge, wherein the horizontal edges are connected to the vertical edges forming a space therebetween;

(iii) a closed cell foam disposed within the space;

(iv) a front skin disposed over both of the horizontal edges, both of the vertical edges, and the closed cell foam, wherein the front skin is a fiber reinforced polymer substrate substantially between 2 mm and 3.5 mm thick;

(v) a back skin disposed over the edges and the closed cell foam opposite the front skin, wherein the back skin is a fiber reinforced polymer substrate between 2 mm and 3.5 mm and thick;

(vi) a port opening formed through the closed cell foam, front skin, and back skin; and (vii) a port door configured to transition the opening from a closed state to an open state;

b. a double welded impact resistant grill capable of withstanding at least 37 mph impacts, secured to the door over at least the port opening, wherein the double welded impact resistant grill comprises:

(i) a first rod intersecting with a second rod forming an intersecting center grid that has a plurality of zones; wherein each zone of the plurality of zones has a support barrier connection disposed therein, and wherein each support barrier connection engages the first and second rods of the intersecting center grid; and (ii) a plurality of legs on the intersecting grid, wherein each leg has an integral one piece foot formed thereon, and wherein each foot has a central fastening hole formed therethrough; and (iii) a plurality of double welded securing rings, wherein each securing ring encircles the intersecting center grid and two different support barrier connections, simultaneously;

c. a plurality of connection holes formed through the front skin, the back skin and the closed cell foam, wherein each connection hole is aligned with a respective fastening hole; and d. a plurality of fasteners, wherein each fastener is installed through respective connection holes and through one of the aligned fastening holes thereby securing the double welded impact resistant grill to a front skin side of the door forming the hurricane storm resistant door assembly able to sustain 37 mph flying debris impacts without deforming while producing a sound reducing barrier.

2. The hurricane storm resistant door assembly of claim 1, further comprising a top coat on the front skin.

3. The hurricane storm resistant door assembly of claim 1, wherein the port door includes a first port door member and a second port door member positioned side-by-side, a first hinge connecting the first port door member to a first side of the opening, a second hinge connecting the second port door member to a second side of the opening opposite the first side, and a latch allowing the port door members to transition the opening from a closed state to an open state.

4. The hurricane storm resistant door assembly of claim 1, further comprising a first rail disposed adjacent to a top edge of the opening and second rail disposed adjacent to a bottom edge of the opening, and wherein the port door is positioned to engage both rails allowing the port door to slidingly transition the opening from a closed state to an open state.

5. The hurricane storm resistant door assembly of claim 1, wherein the door is fiberglass, wood, composite, pvc, or combinations thereof.

6. The hurricane storm resistant door assembly of claim 1, wherein the double welded impact resistant grill is solid steel.

7. The hurricane storm resistant door assembly of claim 1, wherein each foot extends beyond the opening at least 1 inch.

8. The hurricane storm resistant door assembly of claim 1, further comprising a connecting member between pairs of support barrier connections.

9. The hurricane storm resistant door assembly of claim 8, wherein the connecting member is solid or hollow.

10. The hurricane storm resistant door assembly of claim 1, wherein the first rod and the second rod are steel rods.

* * * * *